US008808060B2

(12) United States Patent
Turner et al.

(10) Patent No.: US 8,808,060 B2
(45) Date of Patent: Aug. 19, 2014

(54) SYSTEMS AND METHODS FOR SHARPENING CUTTING BLADES

(75) Inventors: Romeo O. Turner, Villa Rica, GA (US); Wubendanchi Mitchell, Winnetka, IL (US); Angela Bailey, Setauket, NY (US)

(73) Assignee: Clipp-Aid LLC, Evanston, IL (US)

( * ) Notice: Subject to any disclaimer, the term of this patent is extended or adjusted under 35 U.S.C. 154(b) by 241 days.

(21) Appl. No.: 13/438,913

(22) Filed: Apr. 4, 2012

(65) Prior Publication Data

US 2012/0264356 A1 Oct. 18, 2012

Related U.S. Application Data

(60) Provisional application No. 61/474,374, filed on Apr. 12, 2011.

(51) Int. Cl.

| | |
|---|---|
| ***B24B 1/04*** | (2006.01) |
| ***B24B 3/48*** | (2006.01) |
| ***B24B 31/00*** | (2006.01) |

(52) U.S. Cl.

CPC .. *B24B 3/48* (2013.01); *B24B 31/00* (2013.01)

USPC ..... 451/45

(58) Field of Classification Search

CPC .. B24D 15/061; B24D 15/063; C09K 3/1454; C09K 3/1463; C09K 1/1472; C09K 3/1481

USPC ..... 451/45, 294

See application file for complete search history.

(56) References Cited

U.S. PATENT DOCUMENTS

| | | | | |
|---|---|---|---|---|
| 1,443,660 | A * | 1/1923 | Stephenson | 51/308 |
| 2,313,970 | A | 3/1943 | Roderick | |
| 2,458,257 | A | 1/1949 | Donovan | |
| 2,953,851 | A | 9/1960 | Wheeler | |
| 3,032,939 | A | 5/1962 | Andersen | |
| 3,163,964 | A | 1/1965 | Wheeler | |
| 3,163,965 | A | 1/1965 | Wheeler | |
| 3,319,334 | A | 5/1967 | Bond et al. | |
| 3,513,602 | A | 5/1970 | Fisher | |
| 3,747,276 | A | 7/1973 | Bridwell et al. | |
| 3,918,220 | A | 11/1975 | Jury et al. | |
| 3,932,967 | A | 1/1976 | Hanes | |

(Continued)

FOREIGN PATENT DOCUMENTS

KR 2001078946 A * 8/2001

OTHER PUBLICATIONS

"Garbage disposal How to—Sharpen the blades." Jan. 20, 2010. Warners' Stellian. Jan. 25, 2014. <http://blog.warnersstellian.com/2010/01/20/garbage-disposal-how-to-sharpen-the-blades/>.*

(Continued)

*Primary Examiner* — Joseph J Hail

*Assistant Examiner* — Joel Crandall

(74) *Attorney, Agent, or Firm* — Carter, DeLuca, Farrell & Schmidt, LLP

(57) ABSTRACT

A method of sharpening blades of a hair cutting device includes providing a sharpening composition in substantially crystalline form, activating a hair cutting device, submerging a working end of the hair cutting device at least partially into the sharpening composition, and viewing the sharpening composition. Sharpening is complete when the sharpening composition is substantially transformed to powder form.

5 Claims, 5 Drawing Sheets

(56) References Cited

U.S. PATENT DOCUMENTS

| | | | | |
|---|---|---|---|---|
| 4,028,799 | A | 6/1977 | Rookus | |
| 4,122,603 | A | 10/1978 | Sastri | |
| 4,182,084 | A | 1/1980 | Friedenberg | |
| 4,299,063 | A | 11/1981 | Rookus | |
| 4,305,233 | A | 12/1981 | Wheeler | |
| 4,608,782 | A | 9/1986 | Chylinski | |
| 4,807,360 | A | 2/1989 | Cerier et al. | |
| 4,878,321 | A | 11/1989 | Whitehead | |
| 5,036,731 | A | 8/1991 | Fletcher | |
| 5,092,041 | A | 3/1992 | Podolsky | |
| 5,142,785 | A | 9/1992 | Grewal et al. | |
| 5,232,568 | A | 8/1993 | Parent et al. | |
| 5,257,564 | A | 11/1993 | Janowski | |
| 5,293,689 | A | 3/1994 | Voll | |
| 5,492,038 | A | 2/1996 | Chylinski et al. | |
| 5,669,144 | A | 9/1997 | Hahn et al. | |
| 5,785,586 | A | 7/1998 | Delsignore | |
| 5,795,648 | A | 8/1998 | Goel et al. | |
| 5,957,750 | A | 9/1999 | Brunelli | |
| 5,992,268 | A | 11/1999 | Decker et al. | |
| 6,062,970 | A | 5/2000 | Back | |
| 6,105,261 | A | 8/2000 | Ecer | |
| 6,131,288 | A | 10/2000 | Westerhof et al. | |
| 6,289,593 | B1 | 9/2001 | Decker et al. | |
| 6,389,699 | B1 | 5/2002 | Ecer | |
| 6,530,150 | B1 | 3/2003 | Barish | |
| 7,107,684 | B2 | 9/2006 | Steele et al. | |
| 7,686,675 | B2 | 3/2010 | Steele | |
| 8,177,918 | B2 * | 5/2012 | Schmitt | 134/169 R |
| 2004/0045408 | A1 | 3/2004 | Hoffman | |
| 2010/0041315 | A1 | 2/2010 | Sung | |

OTHER PUBLICATIONS

"Rainbow Salt." Mar. 21, 2011. Design Mom. Jan. 25, 2014. <http://www.designmom.com/2011/03/rainbow-salt/>.*

"Food Salt FAQs." Morton Salt. Jan. 25, 2014. <http://www.mortonsalt.com/faqs/food-salt-faqs>.*

Daniels, Donna. "Colored Salt for Your Easter Table Decoration." Feb. 19, 2009. Yahoo Voices. Jan. 25, 2014. <http://voices.yahoo.com/colored-salt-easter-table-decoration-2651483.html>.*

"Shiny Sinks MSDS." Homecare Products. Nov. 2001.*

"Propylparaben." SoapGoods. Jan. 24, 2014. <http://www.soapgoods.com/Propylparaben-p-1446.html>.*

"Uses for Salt for Cleaning and Stain Removal." Stain-Removal-101.com. Aug. 2, 2010. <http://www.stain-removal-101.com/uses-for-salt.html>.*

Fitz, M. "American Lawn Mower SK-1 Reel Mower Sharpening Kit Review." Fitz, M. Apr. 7, 2007. Amazon.com. May 4, 2014. <http://www.amazon.com/American-Lawn-Mower-SK-1-Sharpening/dp/B00004R9UM>.*

"Sharpen Electric Shaver Blades." Thrifty Fun. Oct. 17, 2009. <http://www.thriftyfun.com/tf67512638.tip.html>.*

Daniels, Donna. "Colored Salt for Your Easter Table Decoration." Feb. 19, 2009. <http://voices.yahoo.com/colored-salt-easter-table-decoration-2651483.html>.*

"Assorted Food Colors & Egg Dye" McCormick. May 4, 2014. <http://www.mccormick.com/Spices-and-Flavors/Extracts-and-Food-Colors/Food-Colors/Assorted-Food-Colors-and-Egg-Dye>.*

"Calcium Silicate (E552)." WhatsInThisStuff.com. May 4, 2014. <http://www.whatsinthisstuff.com/ingredient/Calcium-Silicate>.*

"Ingredients—Table Salt." Sci-Toys.com. May 4, 2014. <http://sci-toys.com/ingredients/table_salt.html>.*

* cited by examiner

SYSTEMS AND METHODS FOR SHARPENING CUTTING BLADES

CROSS-REFERENCE TO RELATED APPLICATIONS

This application claims the benefit of, and priority to, U.S. Provisional Patent Application No. 61/474,374, filed on Apr. 12, 2011, the entire contents of which are hereby incorporated by reference herein.

BACKGROUND

1. Technical Field

The present disclosure relates to electric hair cutting devices and, more particularly, to systems and methods for sharpening the cutting blades of electric hair clippers, trimmers, and other hair cutting devices.

2. Background of Related Art

An electric hair clipper typically includes a housing configured to be grasped by a user and a pair of blades layered on top of one another at one end of the housing. Typically, one of the blades, e.g., the stationary blade, is fixed relative to the housing, while the other blade, e.g., the movable blade, is movable relative to the stationary blade and the housing. Each of the blades includes a plurality of spaced-apart teeth. A motor (or other suitable mechanism) disposed within the housing is coupled to the movable blade to oscillate the movable blade relative to the stationary blade between an aligned position, wherein the teeth of the blades are aligned with one another, and an offset position, wherein the teeth of the blades are offset relative to one another. The stationary blade is typically disposed exteriorly of the movable blade to shield the movable blade.

In use, when the blades are disposed in the aligned position, hair is permitted to enter the spaces between the aligned teeth. When the blades are subsequently moved to the offset position, the hair disposed between the teeth is cut in a scissor-like fashion. That is, oscillation of the movable blade between the aligned and offset positions allows hair to be repeatedly moved into position between the teeth and subsequently cut.

Other electric hair cutting devices, e.g., electric hair trimmers, include similar components and function similarly to electric hair clippers.

As can be appreciated, if the cutting teeth of one or both of the blades become dull, cutting efficiency may be reduced and the likelihood of hair becoming trapped between the teeth, rather than being cut by the teeth, is increased. Therefore, it is important to periodically sharpen the cutting teeth of the blades to maintain adequate sharpness of the cutting teeth.

SUMMARY

The features of any of the embodiments described herein, to the extent consistent, may be used in conjunction with the features of any of the other embodiments described herein.

A method of sharpening blades of a hair cutting device provided in accordance with embodiments of the present disclosure includes providing a sharpening composition in substantially crystalline form, activating a hair cutting device, e.g., an electric clipper, submerging a working end of the hair cutting device at least partially into the sharpening composition, and viewing the sharpening composition. Sharpening is complete when the sharpening composition is substantially transformed to powder form.

In one embodiment, the sharpening composition may include a sharpening compound or abrasive such as for example, sodium chloride, although other sharpening compounds are also contemplated.

In another embodiment, viewing the sharpening composition includes determining a shade of the sharpening composition, e.g., whether the sharpening composition exhibits a relatively darker shade or a relatively lighter shade. More specifically, the sharpening composition may initially exhibit a relatively darker shade. When sharpening is complete, on the other hand, the sharpening composition exhibits a relatively lighter shade.

In yet another embodiment, the method further includes moving the working end of the hair cutting device through the sharpening composition, e.g., in back and fourth and/or side to side motion, to facilitate sharpening.

In still another embodiment, the sharpening composition is disposed in a substantially transparent pouch. In such an embodiment, the working end of the hair cutting device is inserted into the pouch to at least partially submerge the working end in the sharpening composition.

A sharpening composition is provided in accordance with embodiments of the present disclosure and is configured for sharpening blades of a hair cutting device. The sharpening composition includes a plurality of crystals. The exteriors of the crystals are dyed with a dyed color different from a natural color of the crystals. The sharpening composition initially exhibits a first shade. Upon cutting of the crystals during sharpening of a hair cutting device, the interiors of the crystals are exposed such that the sharpening composition exhibits a second shade that is different from, e.g., lighter than, the first shade.

In one embodiment, the sharpening composition is transformed from a substantially crystalline form to a substantially powder form during sharpening. Further, the sharpening composition exhibits the first shade when in the substantially crystalline form and the second shade when in the substantially powder form.

In another embodiment, the crystals are formed from sodium chloride.

In another embodiment, the crystals are dyed with food coloring. Further, the dyed color of the crystals may be darker in shade than then natural color of the crystals.

In embodiments, the sharpening composition may include a preservative.

In other embodiments, the sharpening composition may include an anti-coalescing agent or agent for adsorbing water and/or oils.

Also provided in accordance with embodiments of the present disclosure is a kit for sharpening blades of a hair cutting device. The kit generally includes a receptacle, a sharpening composition, a pouch, and a dispensing spoon. The sharpening composition is initially disposed within the receptacle. The pouch is configured for receiving at least a portion of the sharpening composition. The dispensing spoon is configured for transferring at least a portion of the sharpening composition from the receptacle to the pouch.

In one embodiment, the sharpening composition includes a plurality of crystals formed from sodium chloride. Further, the crystals may be dyed with food coloring.

In another embodiment, the pouch is substantially transparent to permit visualization into the interior of the pouch.

In yet another embodiment, the receptacle includes a base and a lid releasably engagable with the base to retain the sharpening composition therein.

BRIEF DESCRIPTION OF THE DRAWINGS

Various aspects of the present disclosure are described herein with reference to the drawings wherein like reference numerals identify similar or identical elements.

DETAILED DESCRIPTION

Figure 1:
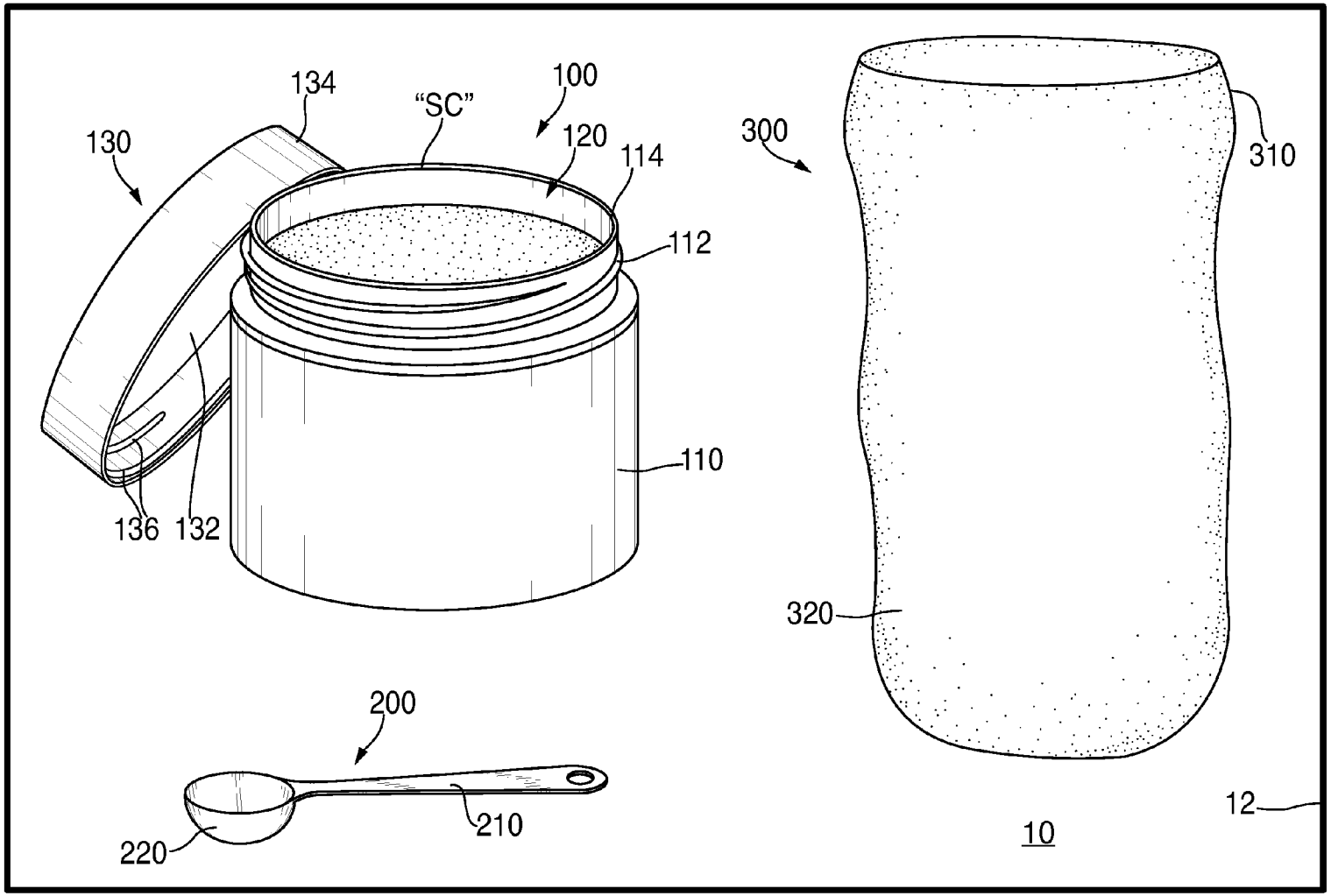
FIG. 1 illustrates a blade sharpening system, or kit, provided in accordance with the present disclosure and shown including a receptacle configured to retain a sharpening composition therein, a dispensing spoon, and a pouch.

Turning now to FIG. 1, an illustrative embodiment of a blade sharpening system provided in accordance with the present disclosure is shown generally identified by reference numeral 10. Blade sharpening system 10 may be provided as a blade sharpening kit 12, although the components of blade sharpening kit 12 may alternatively be provided separately. Blade sharpening system 10 generally includes a receptacle 100 configured to retain a sharpening composition "SC" therein, a dispensing spoon 200, and a pouch 300.

Receptacle 100 is shown generally including a base 110 having a hollow interior 120 and a lid 130 releasably engagable with base 110. Base 110 may be formed from a plastic or any other suitable material. Base 110 is configured to retain the sharpening composition "SC" therein and includes annular external threading 112 disposed towards the open end 114 thereon. Lid 130 includes a top portion 132 and an annular portion 134 that includes annular internal threading 136 configured complementarily to threading 112 of base 110 to permit releasable engagement of lid 130 about the open end of base 110 to inhibit the sharpening composition "SC" from spilling out of base 110, chemically reacting with other substances, and/or being contaminated by other substances. Other releasable engagement mechanisms, e.g., snap-fit, friction fit, etc., may also be provided.

With continued reference to FIG. 1, dispensing spoon 200 generally includes a handle portion 210 and a scoop portion 220. Dispensing spoon 200 is configured to facilitate the transfer of the sharpening composition "SC" from receptacle 100 to pouch 300 in measured increments. For example, dispensing spoon 200 may be configured to define a capacity of about ⅛ teaspoon, although other size dispensing spoons are also contemplated.

Pouch 300 is formed from any suitable tear-resistant, transparent or partially transparent, and impermeable material for retaining the sharpening composition "SC" therein. The pouch 300 has sufficient transparency so as to permit the user to visualize the sharpening composition "SC" from the exterior of pouch 300. Pouch 300 defines an open end 310 that is configured to permit the sharpening composition "SC" to be deposited into the interior of pouch 300. Pouch 300 is configured to permit insertion of the working end of an electric hair clipper 400 (FIG. 2), electric hair trimmer (not shown), or other similar device therein, as will be described in greater detail below.

Figure 5C:
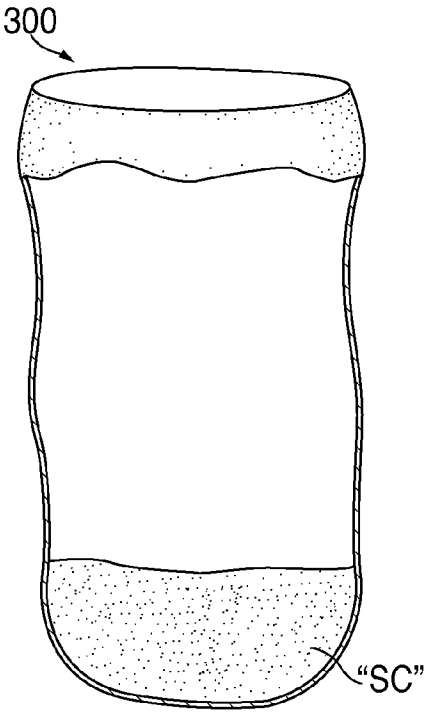
FIG. 5A is a side view of the pouch of FIG. 1 including the sharpening composition disposed therein in crystalline form.
FIG. 5B is a side view of the pouch of FIG. 1 including the head of the electric hair clipper of FIG. 2 submerged within the sharpening composition in crystalline for FIG. 5C is a side view of the pouch of FIG. 1 including the sharpening compound disposed therein in powder form.

Continuing with reference to FIG. 1, the sharpening composition "SC," as will be described in greater detail below, is initially provided in crystalline form. The sharpening composition "SC" may primarily include an abrasive substance such as sodium chloride, although other suitable abrasive substances or combinations of substances may also be provided. Further, the exteriors of the crystals (e.g., the exposed surface area of the crystals) of the sharpening composition "SC," including e.g., the sodium chloride crystals, may be dyed with any suitable dye, both natural and/or synthetic dyes, e.g., food coloring, and/or pigments to provide better contrast relative to the natural color or shade of the sharpening composition "SC" to facilitate visualization of the state of the sharpening composition "SC." That is, dyeing the sharpening composition "SC" facilitates the visual determination of whether the sharpening composition "SC" is in a crystalline state (FIGS. 5A-5B) or a powder state (FIG. 5C), the importance of which will become more apparent hereinbelow. For example, the exteriors of the crystals of the sharpening composition "SC" may be dyed a relatively dark color or shade as compared to the interior thereof, although other configurations are also contemplated.

The sharpening composition of the present disclosure may also include a preservative. Suitable preservatives may include, for example, propylparaben, methylparaben, ethylparaben, butylparaben, sodium benzoate, potassium sorbate, and combinations thereof. In embodiments, the preservative may be propylparaben. The preservative may be present in the sharpening composition in an amount of from about 0.01% to about 1.0% by weight. In embodiments, the preservative is present in an amount about 0.1% to about 0.75% by weight.

The sharpening composition of the present disclosure may also include an anti-coalescing agent or additive to prevent the formation of lumps in the sharpening composition and for ease in packaging, storage and transport. They function either by absorbing excess moisture, or by coating the plurality of crystals and making them water and/or oil repellent. Suitable anti-coalescing agents may include calcium silicate, sodium silicate, sodium aluminosilicate, calcium aluminosilicate, aluminium silicate, potassium aluminium silicate, magnesium trisilicate, sodium ferrocyanide, potassium ferrocyanide, calcium ferrocyanide, calcium carbonate, magnesium carbonate, tricalcium phosphate, powdered cellulose, sodium bicarbonate, bone phosphate, silicon dioxide, talcum powder, bentonite, stearic acid, polydimethylsiloxane, dextrose, and combinations thereof.

In embodiments, the anti-coalescing agent may be calcium silicate. In embodiments, calcium silicate may be a finely divided product having an average ultimate particle size below about 0.1 microns, and having a surface area ranging between about 10 to about 150 square meters per gram. In embodiments, the calcium silicate may be incorporated in the sharpening composition simply by mixing commercial abrasive such as for example, crystalline sodium chloride, which may or may not contain impurities, with the finely divided calcium silicate. In embodiments, approximately 2% by weight of the calcium silicate, based upon the weight of sodium chloride, may be suitable. However, other concentrations, for example, about 0.5% to about 5% by weight of calcium silicate, based on the sodium chloride weight, may be used if desired.

The sharpening composition may include other components, such as potassium iodide, sodium iodide, sodium thiosulphate, the like, and combinations thereof.

Figure 2:
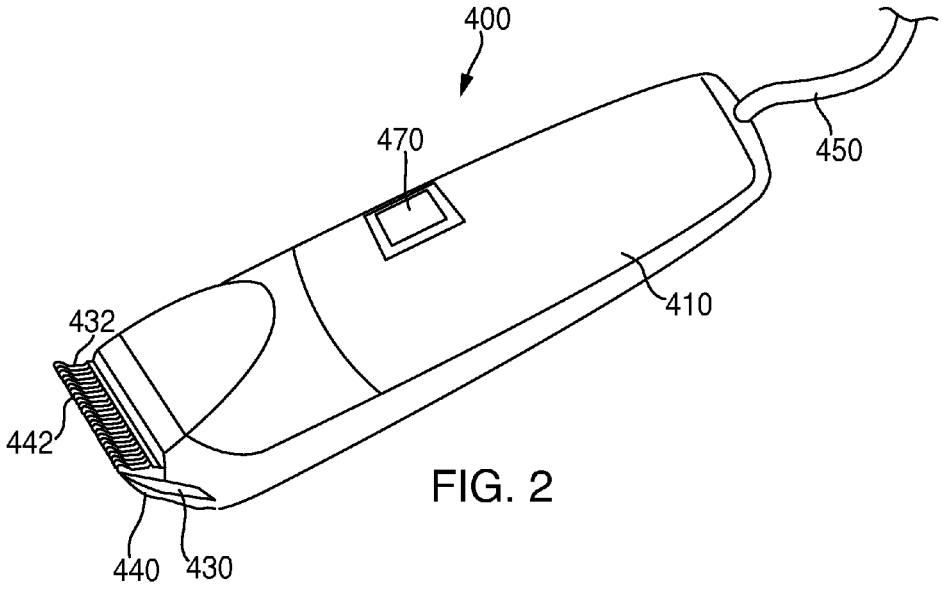
FIG. 2 is a perspective view of an exemplary electric hair clipper configured for use with the sharpening systems and methods of the present disclosure.
Figure 3:
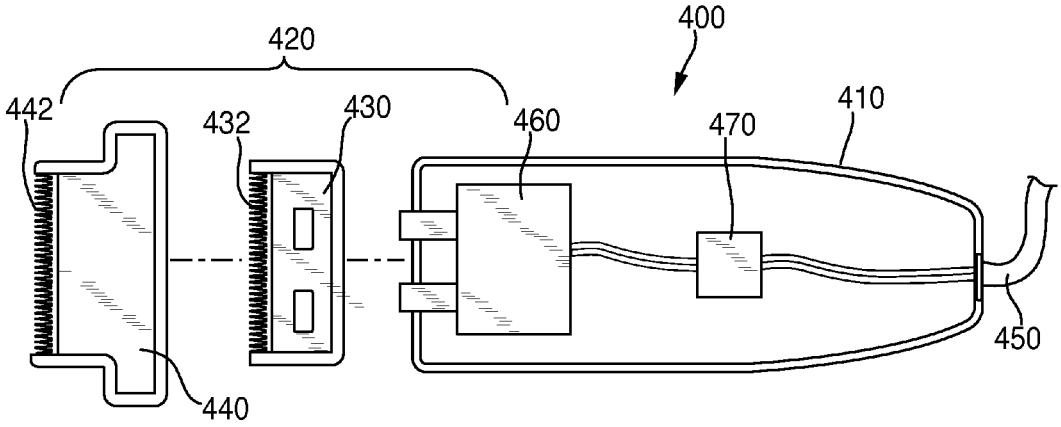
FIG. 3 is a top, exploded view of the electric hair clipper of FIG. 2 wherein a portion of the housing has been removed to show the internal components thereof.

Turning to FIGS. 2 and 3, an electric hair clipper provided in accordance with the present disclosure and configured for use with blade sharpening system 10 (FIG. 1) is shown generally designated by reference numeral 400. Although only one embodiment of an electric hair clipper 400 is shown, it is contemplated that the systems and methods of the present disclosure are equally applicable for use with any powered hair cutting device, e.g., clippers, trimmers, etc. having one or more moving blades that require sharpening.

Clipper 400 generally includes a handle portion or housing 410 configured to be grasped by a user, a working end 420 which supports movable and stationary blades 430, 440, respectively, and a cord 450 for connecting clipper 400 to a source of energy (although clipper 400 may alternatively be configured as a battery-powered device). Movable blade 430 is disposed at working end 420 of clipper 400 and is operably coupled to a motor 460 disposed within housing 410. Motor 460, in turn, is electrically coupled to the source of energy (not shown), e.g., via cord 450, to power motor 460. An actuator 470 disposed on housing 20 is coupled to motor 460 for selectively activating (and deactivating) motor 460, e.g., turning the clipper 400 ON and OFF. Stationary blade 440 is disposed at working end 420 of clipper 400 exteriorly of movable blade 430 and is fixed relative to housing 410.

Figure 4A:
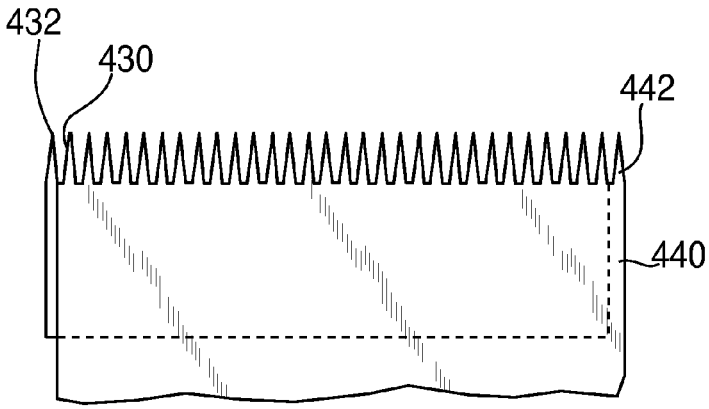
FIG. 4A is a front view of the movable and stationary blades of the electric hair clipper of FIG. 2 shown disposed in the aligned position.
Figure 4B:
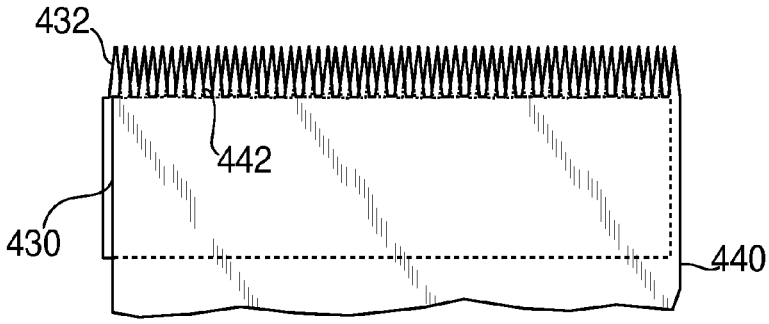
FIG. 4B is a front view of the movable and stationary blades of the electric hair clipper of FIG. 2 shown disposed in the offset position.

As best shown in FIGS. 3, 4A, and 4B, movable and stationary blades 430, 440, respectively, each include a plurality of spaced-apart teeth 432, 442, respectively. As mentioned above, stationary blade 440 is fixed relative to housing 410. Movable blade 430 is coupled to motor 460 for oscillating movable blade 430, e.g., translating movable blade 430 in side-to-side motion, relative to stationary blade 440 between an aligned position (FIG. 4A), wherein teeth 432, 442, of blades 430, 440, respectively, are substantially aligned with one another, and an offset position (FIG. 4B), wherein teeth 432, 442, of blades 430, 440, respectively, are offset relative to one another.

The lateral sides of the teeth 432, 442 of either or both of the movable and stationary blades 430, 440, respectively, define sharpened cutting edges configured to facilitate the cutting of hair disposed between teeth 432, 442 of blades 430, 440, respectively. More specifically, in use, e.g., once actuator 470 is activated to turn clipper 400 ON, motor 460 operates to oscillate movable blade 430 between the aligned position (FIG. 4A), wherein hair is permitted to enter the spaces between the aligned teeth 432, 442, and the offset position (FIG. 4B), wherein the hair disposed between teeth 432, 442 is cut in a sheering, or scissor-like fashion by the sharpened cutting edges of blade(s) 430, 440. As can be appreciated, if the sharpened cutting edges of blade(s) 430, 440 become dull, cutting efficiency is reduced.

Figure 5B:
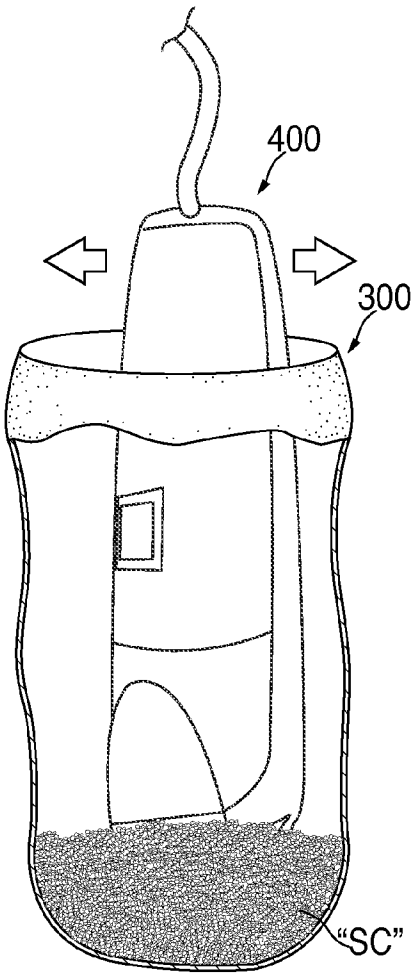
Figure 5A:
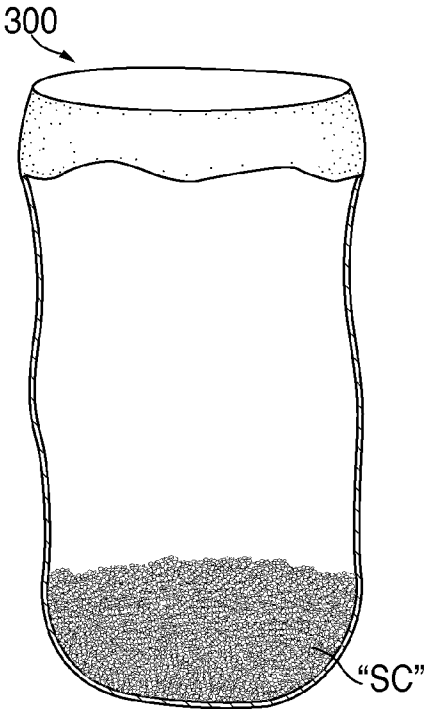
Figure 6:
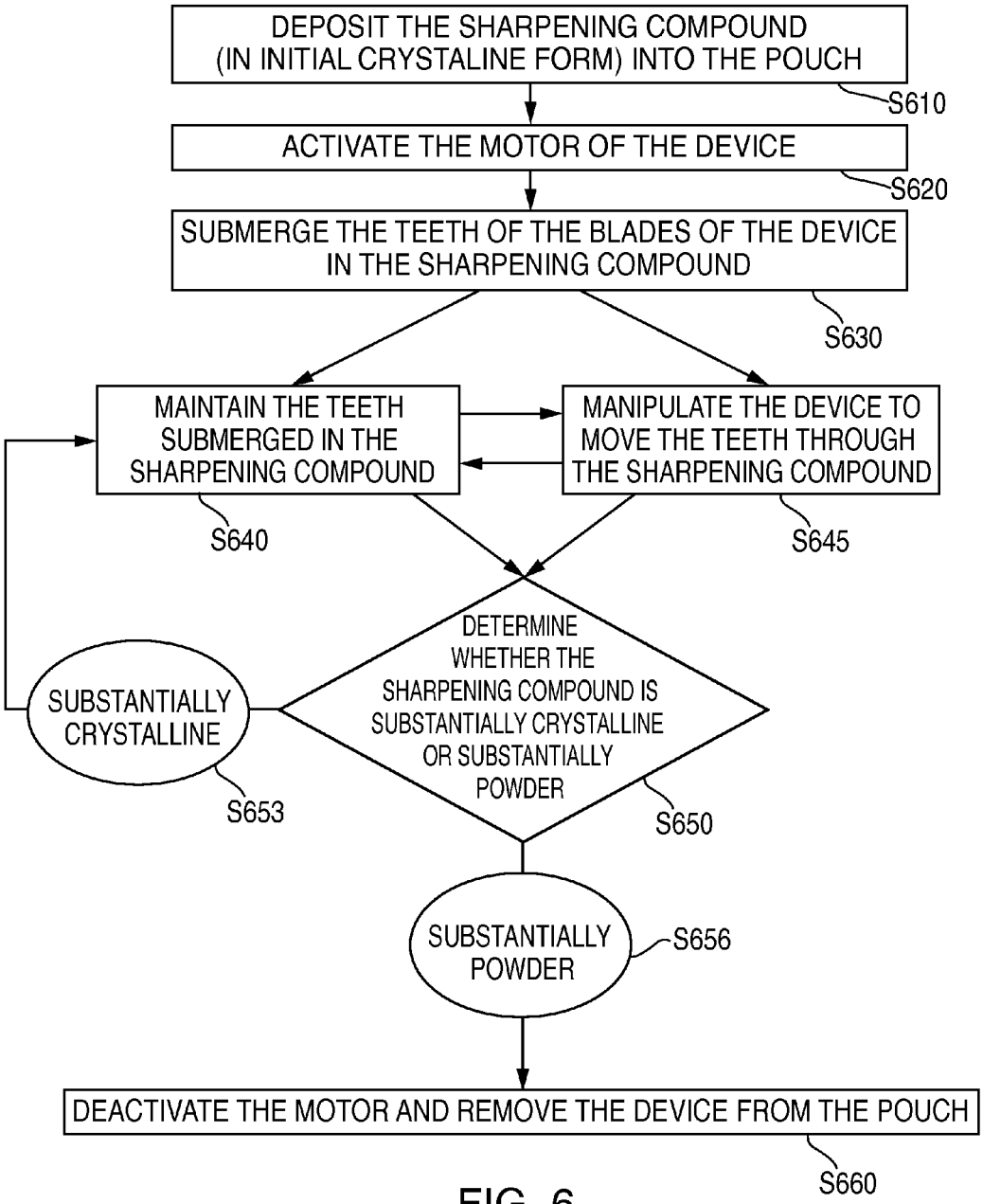
FIG. 6 is a flow diagram of a blade sharpening method provided in accordance with the present disclosure.

Referring now to FIGS. 5A, 5B, and 6, in conjunction with FIGS. 1, 2, 3, 4A, and 4B, the use and operation of blade sharpening system 10, e.g., for sharpening blades 430, 440 of clipper 400, is described. Although described with respect to clipper 400, blade sharpening system 10 and the methods of sharpening cutting blades described herein may alternatively be used for sharpening the blades of any suitable powered hair cutting device, e.g., clippers, trimmers, etc. In preparation for sharpening, blades 430, 440 of clipper 400 are cleaned in accordance with the manufacturer's instructions or accepted industry standards. For example, sharpening blades 430, 440 of clipper 400 may be cleaned by brushing off any excess debris from the blades and then submerging the blades in an antibacterial cleaning solution. Once blades 430, 440 of clipper 400 are cleaned, blades 430, 440 are ready for sharpening.

Initially, as indicated in step S610, an appropriate amount of sharpening composition "SC," in its initial crystalline form, is deposited into pouch 300. More particularly, the user removes lid 130 of receptacle 100 and, using dispensing spoon 200, scoops the appropriate amount of crystalline sharpening composition "SC" out of receptacle 100, and deposits the sharpening composition "SC" into pouch 300. An appropriate amount of sharpening composition is that which is sufficient to immerse the teeth 432, 442 of blades 430, 440. For example, it has been found that ¼ teaspoon is a sufficient amount of sharpening composition "SC" for sharpening clipper blades, e.g., blades 430, 440 of clipper 400, while ⅛ teaspoon is sufficient for sharpening trimmer blades (not shown). However, other amounts are also contemplated. As mentioned above, configuring dispensing spoon 200 to define a capacity of ⅛ teaspoon (or other suitable incremental capacity) allows the user to quickly and easily deposit the appropriate amount of sharpening composition "SC" into pouch 300, e.g., one scoop (for clippers) or two scoops (for trimmers).

As indicated in step S620, motor 460 of clipper 400 is activated, e.g., via depressing actuator 470, to turn clipper 400 ON, e.g., to oscillate movable blade 430 relative to stationary blade 440. Once the sharpening composition "SC" has been deposited into pouch 300 and with clipper 400 in the ON state, working end 420 of clipper 400 is inserted into pouch 300 such that movable and stationary blades 430, 440 of clipper 400 are at least partially submerged in the sharpening composition "SC," as indicated in step S630. More specifically, blades 430, 440 are submerged in the sharpening composition "SC" sufficiently such that teeth 432, 442 of blades 430, 440, respectively, are submerged in the sharpening composition "SC." Alternatively, working end 420 of clipper 400 may be submerged in the sharpening composition "SC" prior to activating motor 460.

Next, as indicated in steps S640 and S645, teeth 432, 442 of blades 430, 440, respectively, are maintained in position (submerged in the sharpening composition "SC") or clipper 400 is manipulated, e.g., in a side-to-side and/or back and forth motion relative to pouch 300, to move teeth 432, 442 through the sharpening composition "SC" (while also maintaining teeth 432, 442 of blades 430, 440 submerged in the sharpening composition "SC"). Manipulating clipper 400 such that teeth 432, 442 are moved through sharpening composition "SC" facilitates the sharpening process. More specifically, it has been found that, for a typical hair cutting device, e.g., clipper 400, blades 430, 440 will be sufficiently sharpened between about less than 1 minute and to about 3 minutes, in other embodiments between about 1 minute to about 2 minutes if clipper 400 is continuously manipulated within the sharpening composition "SC." In embodiments, if the clipper 400, blades 430, 440 are not sufficiently sharpened in the disclosed sharpening times, sharpening may be repeated as necessary until desired sharpness is achieved. On the other hand, sufficient sharpening may require up to about 15 minutes where clipper 400 remains generally stationary relative to pouch 300 and sharpening composition "SC" during the sharpening process. The above-noted sharpening times are provided for exemplary and comparative purposes only. The presently disclosed sharpening systems and methods, as will be described below, allow the user to visually verify when sharpening is complete, rather than relying on a pre-determined sharpening time.

As can be appreciated, depending on the configuration and state of the cutting blades, the particular device used, the degree of manipulation (or lack thereof) of the device within pouch 300, and other factors, sharpening times may vary. Accordingly, relying on a pre-determined sharpening time may prove insufficient, e.g., may result in under-sharpening or over-sharpening.

In order to determine whether sharpening is complete in accordance with the systems and methods of the present disclosure, as indicated in step S650, the user views the sharpening composition "SC" through pouch 300 to determine whether the sharpening composition "SC" is in substantially crystalline form (its original form) or has been transformed to a substantially powder form. During sharpening, the crystals of the sharpening composition "SC" are moved between teeth 432, 442 of blades 430, 440 when teeth 432, 442 are disposed in the aligned position and are subsequently cut or broken by sheering teeth 432, 442 as the teeth 432, 442 are moved to the offset position. This process sharpens the lateral cutting edges of the teeth 432, 442 of blades 430, 440, respectively. As the crystals are cut or broken and as the cut or broken crystal fragments are cut or broken further, sharpening composition "SC" is converted into powder form. That is, conversion of the sharpening composition "SC" from crystalline form to powder form coincides with the sharpening of blades 430, 440 of clipper 400. Thus, determining whether the sharpening composition "SC" is substantially crystalline (i.e., relatively little sharpening has occurred) or substantially powder (i.e., relatively more sharpening has occurred) indicates whether sharpening is complete or more sharpening is required.

With continued reference to step S650 of FIG. 6, determining whether the sharpening composition "SC" is substantially crystalline or substantially powder is not only accomplished by viewing the sharpening composition "SC" to determine the size of the particles, but may also be accomplished by viewing the color or shade of the sharpening composition "SC." That is, since the exteriors of the crystals (e.g., the exposed surface area of the crystals) of the sharpening composition "SC" are dyed with a relatively dark color or shade to contrast with the natural lighter color or shade (e.g., the unexposed, internal portions of the crystals) of the sharpening composition "SC," the overall color or shade of the sharpening composition "SC" lightens as the crystals are cut or broken into smaller pieces and, ultimately, into powder form. This is because, during the cutting or breaking of the crystals, the interior of the crystals, which are un-dyed and, thus, exhibit the natural, lighter color or shade of the sharpening composition "SC" become exposed, thus lightening the overall color or shade of the sharpening composition "SC." Accordingly, when the sharpening composition "SC" has substantially changed from its initial, darker color or shade of the dyed crystals to the lighter color or shade of the powder, the user is alerted that sharpening is complete by the color or shade change of the sharpening composition "SC."

As indicated by step S653, if sharpening is not yet complete, e.g., if the sharpening composition "SC" is still substantially crystalline (exhibiting the dyed, darker color or shade), the method reverts back to steps S640 and/or S645, wherein teeth 432, 442 of blades 430, 440 are maintained in position (submerged in the sharpening composition "SC") and/or clipper 400 is manipulated relative to pouch 300, to move teeth 432, 442 through sharpening composition "SC."

As indicated by step S656, if sharpening is complete, e.g., if the sharpening composition "SC" is substantially powder (exhibiting the lighter, natural color or shade), the method proceeds to step S660, wherein motor 460 of clipper 400 is deactivated, thus turning clipper 400 OFF. Clipper 400 is then be removed from pouch 300. Finally, blades 430, 440 of clipper 400 are once again cleaned, rendering clipper 400 sharpened, cleaned, and ready for re-use.

While several embodiments of the disclosure have been shown in the drawings, it is not intended that the disclosure be limited thereto, as it is intended that the disclosure be as broad in scope as the art will allow and that the specification be read likewise. Therefore, the above description should not be construed as limiting, but merely as exemplifications of particular embodiments. Those skilled in the art will envision other modifications within the scope and spirit of the claims appended hereto.

What is claimed is:

1. A method of sharpening blades of a hair cutting device, comprising:

providing a sharpening composition including a plurality of crystals, each crystal having an exterior surface area and an interior, the interior having a natural color, the exterior surface area dyed a color different from the natural interior color of the crystals;

activating a hair cutting device;

prior to or after activating the hair cutting device, submerging a working end of the hair cutting device at least partially into the sharpening composition, wherein with the working end of the hair cutting device at least partially submerged within the sharpening composition and the hair cutting device activated, blades of the hair cutting device are sharpened by crushing the crystals of the sharpening composition into a substantially powder form, wherein crushing the crystals exposes the interiors of the crystals;

viewing the sharpening composition during sharpening; and determining that sharpening is complete when a color of the sharpening composition is substantially changed from the dyed color to a color of a lighter shade due to the fact that the interiors of the crystals, which have the natural color, are exposed.

2. The method according to claim 1, wherein the sharpening composition includes an abrasive substance.

3. The method according to claim 2, wherein the abrasive substance is sodium chloride.

4. The method according to claim 1, further comprising the step of moving the working end of the hair cutting device through the sharpening composition to facilitate sharpening.

5. The method according to claim 1, wherein the sharpening composition is disposed in a pouch and wherein the working end of the hair cutting device is inserted into the pouch to at least partially submerge the working end in the sharpening composition.

* * * * *